United States Patent [19]

Shishido et al.

[11] 4,431,483

[45] Feb. 14, 1984

[54] APPARATUS FOR DISTILLING SHALE OIL FROM OIL SHALE

[75] Inventors: Takeyoshi Shishido, Mitaka; Yoshio Sato, Kamakura, both of Japan

[73] Assignee: Nippon Kokan Kabushiki Kaisha, Tokyo, Japan

[21] Appl. No.: 361,579

[22] Filed: Mar. 24, 1982

[30] Foreign Application Priority Data

Apr. 15, 1981 [JP] Japan ..... 56-55506

[51] Int. Cl.[3] ..... C10B 1/04; C10B 49/06; C10B 53/06

[52] U.S. Cl. ..... 202/99; 201/34; 202/215; 208/11 R

[58] Field of Search ..... 202/99, 108, 215; 201/29, 34, 35; 208/8 R, 11 R

[56] References Cited

U.S. PATENT DOCUMENTS

| | | | |
|---|---|---|---|
| 1,895,284 | 1/1933 | Hay | 202/215 |
| 2,448,223 | 8/1948 | Lantz | 202/99 |
| 2,698,283 | 12/1954 | Dalin | 201/35 |
| 2,996,437 | 8/1961 | Mewes et al. | 202/99 |
| 4,010,092 | 3/1977 | Deering | 208/11 R |
| 4,042,485 | 8/1977 | Jones, Jr. et al. | 208/11 R |
| 4,058,905 | 11/1977 | Knight | 208/11 R |
| 4,087,347 | 5/1978 | Langlois et al. | 201/34 |

FOREIGN PATENT DOCUMENTS

| | | | |
|---|---|---|---|
| 414536 | 4/1969 | Australia . | |
| 499833 | 12/1975 | Australia . | |
| 343048 | 5/1917 | Fed. Rep. of Germany | 201/34 |
| 390842 | 6/1923 | Fed. Rep. of Germany . | |
| 620399 | 9/1935 | Fed. Rep. of Germany | 201/34 |
| 745222 | 12/1943 | Fed. Rep. of Germany . | |
| 487983 | 6/1938 | United Kingdom | 201/34 |

OTHER PUBLICATIONS

Hans—Joachim v. Alberti: "SCHWELFIBEL", Halle 1956, p. 184.

*Primary Examiner*—Bradley Garris

*Attorney, Agent, or Firm*—Frishauf, Holtz, Goodman & Woodward

[57] ABSTRACT

An apparatus for distilling shale oil from oil shale, which comprises: a vertical type distilling furnace which is divided by two vertical partitions each provided with a plurality of vent apertures into an oil shale treating chamber and two gas chambers, said oil shale treating chamber being located between said two gas chambers in said vertical type distilling furnace, said vertical type distilling furnace being further divided by at least one horizontal partition into an oil shale distilling chamber in the lower part thereof and at least one oil shale preheating chamber in the upper part thereof, said oil shale distilling chamber and said oil shale preheating chamber communicating with each other through a gap provided at an end of said horizontal partition, an oil shale supplied continuously from an oil shale supply port provided in said oil shale treating chamber at the top thereof into said oil shale treating chamber continuously moving from the oil shale preheating chamber to the oil shale distilling chamber, a high-temperature gas blown into an oil shale distilling chamber passing horizontally through said oil shale in said oil shale treating chamber, thereby said oil shale is preheated in said oil shale preheating chamber, and a gaseous shale oil is distilled from said preheated oil shale in said oil shale distilling chamber; and a separator for separating by liquefaction a gaseous shale oil from a gas containing the gaseous shale oil discharged from the oil shale preheating chamber.

2 Claims, 3 Drawing Figures

APPARATUS FOR DISTILLING SHALE OIL FROM OIL SHALE

FIELD OF THE INVENTION

The present invention relates to an apparatus for distilling a shale oil from an oil shale by means of a high-temperature gas.

BACKGROUND OF THE INVENTION

Along with the recent world-wide tendency toward exhaustion of petroleum resources, the general attention is given to shale oil available from oil shale existent underground in large quantities as a new fuel oil. However, since shale oil is contained in oil shale in only such a small amount as for example about 60 kg per ton of oil shale, industrial distillation of shale oil from oil shale requires huge distilling facilities. There is therefore a demand for developing a method for efficiently distilling shale oil from oil shale.

The methods for distilling shale oil from oil shale now in operation in an industrial scale or considered to be in operation in the future in an industrial scale may be broadly classified into the following three types, depending upon the means for supplying the heat for distillation:

(1) with the heat of fuel burning in the distilling furnace;

(2) with the heat of a high-temperature granular heat medium supplied into the distilling furnace; and, (3) with the heat of a high-temperature gaseous heat medium blown into the distilling furnace.

In the method (1), a fuel and the air are blown directly into the distilling furnace fed with an oil shale to cause combustion of the blown fuel, and a shale oil is distilled from the oil shale with the combustion heat of the fuel. This method, having the advantage of a high thermal efficiency for distillation, is problematic in that the quality of the resultant shale oil is degraded by the combustion waste gas and the yield of shale oil is rather low.

In the method (2), an oil shale is supplied together with a high-temperature granular heat medium, and a shale oil is distilled from the oil shale with the heat contained in the granular heat medium. This method is advantageous in that a high-quality shale oil is available. The method (2) is however problematic in that distillation requires a large quantity of high-temperature granular heat medium and a separator for separating the granular heat medium from the waste oil shale after distillation treatment, thus resulting in complicated facilities. Another problem is that, when the granular heat medium wears to a smaller particle size, separation becomes impossible with a screeen commonly employed as the above-mentioned separator.

In the method (3), a high-temperature gas as the heat medium is blown into the distilling furnace fed with an oil shale, and a shale oil is distilled from the oil shale by the heat of the blown gas. This method is advantageous in the availability of a high-quality shale oil and because the heat medium is a gas, the method does not require a separator for separating the heat medium from the waste oil shale, as in the method (2), thus requiring only relatively simple facilities.

The above mentioned method (3) for distilling a shale oil from an oil shale with a high-temperature gas as the heat medium is disclosed in the U.S. Pat. No. 4,010,092 (hereinafter referred to as the "prior art 1"), the U.S. Pat. No. 4,042,485 (hereinafter referred to as the "prior art 2"), and the U.S. Pat. No. 4,058,905 (hereinafter referred to as the "prior art 3").

The above-mentioned prior art 1 is a method which comprises employing a vertical type distilling furnace, supplying oil shale into the distilling furnace from the bottom thereof, causing continuous ascent of the oil shale through the distilling furnace toward the top thereof by means of a Rock pump provided at the bottom of the distilling furnace and discharging the oil shale from the top of the distilling furnace, and in the meantime, bringing the oil shale into counter-current contact with a high-temperature gas blown into the distilling furnace from the top thereof toward the bottom thereof, thereby distilling a shale oil from the oil shale with the heat contained in the gas. However, it is difficult for the prior art 1 to treat a large quantity of oil shale at a time because of the limited capacity of the Rock pump for forcing up the oil shale from the bottom toward the top of the distilling furnace. In addition, the contact of the oil shale with the high-temperature gas in the distilling furance, being done in counter current in the vertical direction of the distilling furnace, leads to a larger pressure drop of the gas, thus bringing about a limit in scaling up the distilling furnace.

The above-mentioned prior art 2 is a method which comprises using a vertical type distilling furnace, supplying an oil shale into the distilling furnace from the top thereof, causing continuous descent of the oil shale through the distilling furnace toward the bottom thereof, discharging the oil shale from the bottom of the distilling furnace, and in the meantime, bringing the oil shale into counter-current contact with a high-temperature gas blown into the distilling furnace from the bottom toward the top thereof to distill a shale oil from the oil shale with the heat of the gas. However, the prior art 2 is problematic in that, as the contact of the oil shale with the high-temperature gas in the distilling furnace is in counter current in the vertical direction of the distilling furnace, there is a considerable pressure drop of the gas, leading to a limit in scaling up the distilling furnace.

The above-mentioned prior art 3 is a method which comprises using a circular-shaped horizontal rotary distilling furnace, charging an oil shale into the distilling furnace, bringing the oil shale into contact with a high-temperature gas blown into the distilling furnace from the top toward the bottom thereof while moving the oil shale in rotation to distill a shale oil from the oil shale with the heat of the gas. However, the prior art 3 is problematic in that the rotation of the distilling furnace with the oil shale charged therein requires much power cost and leads to considerable leakage of the blown gas, resulting in a low distilling efficiency.

As described above, the methods comprising blowing a high-temperature gas as the heat medium into a distilling furnace supplied with an oil shale and distilling a shale oil from the oil shale with the heat of the gas, being advantageous in the availability of a high-quality shale oil and relatively simple facilities, are problematic in that the large pressure drop of the gas blown into the distilling furnace makes it impossible to employ a large-capacity distilling furnace, thus leading to a low testing efficiency of oil shale.

Under such circumstances, there is a strong demand for developing an apparatus which permits, when blowing a high-temperature gas as the heat medium into a distilling furnace supplied with oil shale and distilling shale oil from the oil shale with the heat of the gas, effective treatment of the oil shale in a large-capacity distilling furnace with a slight pressure drop of the gas blown into the distilling furnace, but such an apparatus is not as yet proposed.

SUMMARY OF THE INVENTION

An object of the present invention is therefore to provide an apparatus for distilling a shale oil from an oil shale, which permits, when blowing a high-temperature gas as the heat medium into a distilling furnace supplied with an oil shale and distilling a shale oil from the oil shale with the heat of the gas, effective treatment of a large quantity of oil shale in a large-capacity distilling furnace with a slight pressure drop of the gas blown into the distilling furnace.

In accordance with one of the features of the present invention, there is provided an apparatus for distilling a shale oil from an oil shale, which comprises:

a vertical type distilling furnace which is divided by two vertical partitions each provided with a plurality of vent apertures into an oil shale treating chamber and two gas chambers, said oil shale treating chamber being located between said two gas chambers in said vertical type distilling furnace, said oil shale treating chamber being provided with an oil shale supply port at the top thereof and a waste oil shale discharge port at the bottom thereof, said vertical type distilling furnace being further divided by at least one horizontal partition into an oil shale distilling chamber in the lower part thereof and at least one oil shale preheating chamber in the upper part thereof, said oil shale distilling chamber and said oil shale preheating chamber communicating with each other through a gap provided at an end of said horizontal partition, said oil shale distilling chamber being provided with a gas blowing port for blowing a high-temperature gas into said oil shale distilling chamber, said oil shale distilling chamber being adapted to distill a gaseous shale oil from an oil shale in said oil shale treating chamber, said oil shale preheating chamber being provided with a gas discharge port for discharging a gas containing a gaseous shale oil distilled from an oil shale in said oil shale distilling chamber, said oil shale preheating chamber being adapted to preheat an oil shale in said oil shale treating chamber, and an oil shale supplied continuously from said oil shale supply port into said oil shale treating chamber continuously moving from said oil shale preheating chamber to said oil shale distilling chamber;

whereby a high-temperature gas blown through said gas blowing port into an oil shale distilling chamber passes horizontally through said plurality of vent apertures of said two vertical partitions and through said oil shale in said oil shale treating chamber, thereby an oil shale being preheated in said oil shale preheating chamber, and, a gaseous shale oil being distilled from said preheated oil shale in said oil shale distilling chamber; and, a separator for liquefying said gaseous shale oil contained in said high-temperature gas which is blown into said separator through said gas discharge port to separate said gaseous shale oil from said gas, said separator being provided at the bottom thereof with a shale oil discharge port for discharging the thus liquefied shale oil, and being provided at the top thereof with a gas discharge port for discharging said gas after separation of said gaseous shale oil at the top thereof.

DETAILED DESCRIPTION OF THE PREFERRED EMBODIMENTS

Now, an embodiment of the apparatus for distilling a shale oil from an oil shale of the present invention is hereinafter described with reference to the drawings.

Figure 1:
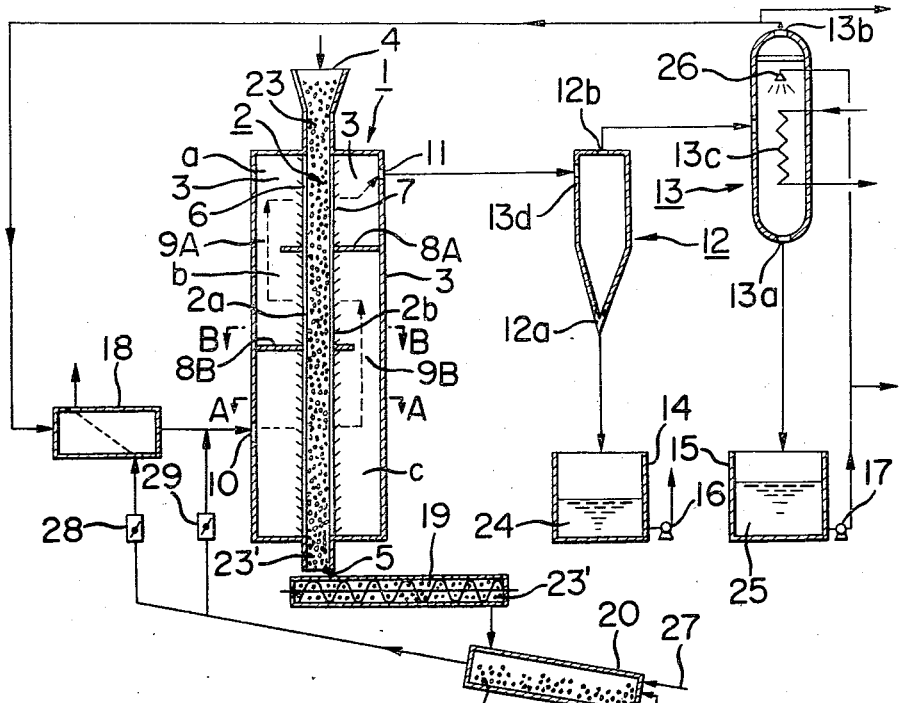
FIG. 1 is a schematic sectional view illustrating an embodiment of the apparatus of the present invention.
Figure 2:
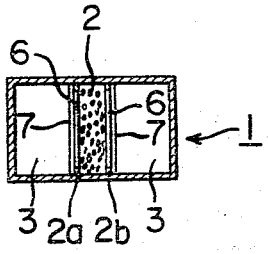
FIG. 2 is a sectional view of FIG. 1 cut along the line A—A.
Figure 3:
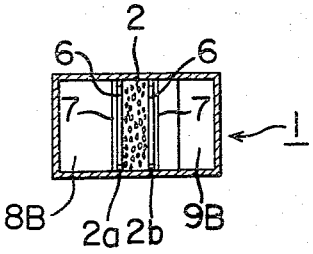
FIG. 3 is a sectional view of FIG. 1 cut along the line B—B.

FIG. 1 is a schematic sectional view illustrating an embodiment of the apparatus for distilling shale oil from oil shale of the present invention; FIG. 2 is a sectional view of FIG. 1 cut along the line A—A; and, FIG. 3 is a sectional view of FIG. 1 cut along the line B—B. In FIGS. 1, 2 and 3, 1 is a vertical type distilling furnace. The vertical type distilling furnace 1 has a rectangular horizontal cross-section, of which the interior is divided by two vertical partitions 2*a* and 2*b* into an oil shale treating chamber 2 and two gas chambers 3. The oil shale treating chamber 2 is located between the two gas chambers 3 in the vertical type distilling furnace 1. The vertical partitions 2*a* and 2*b* are provided over the entire length in the vertical direction thereof with a plurality of vent apertures 6. In this embodiment, each of the plurality of vent apertures 6 is formed by louver board 7, thereby forming the vertical partitions 2*a* and 2*b* into louver-like walls. In FIG. 1, the oil shale treating chamber 2 is provided with an oil shale supply port 4 at the top thereof and a waste oil shale discharge port 5 at the bottom thereof.

In FIG. 1, 8A and 8B are horizontal partitions which divide the vertical type distilling furnace 1 in the vertical direction into two upper oil shale preheating chambers "a" and "b" and a lower oil shale distilling chamber "c". A gap 9A is provided at an end of the horizontal partition 8A, and another gap 9B is provided at the end of the horizontal partition 8B opposite to the gap 9A of the horizontal partition 8A. The oil shale preheating chambers "a" and "b" and the oil shale distilling chamber "c" communicate with each other through these gaps 9A and 9B.

In FIG. 1, 10 is a heating gas blowing port, provided in the oil shale distilling chamber "c", for blowing a high-temperature gas into the oil shale distilling chamber "c". The oil shale distilling chamber "c" is adapted to distill a gaseous shale oil from an oil shale 23 in the oil shale treating chamber 2 by means of the heating high-temperature gas blown through the heating gas blowing port 10.

Also in FIG. 1, 11 is a gas discharge port, provided in the oil shale preheating chamber "a", for discharging a gas containing the gaseous shale oil distilled in the oil shale distilling chamber "c". The oil shale preheating chambers "a" and "b" are adapted to preheat the oil shale 23, which is supplied into the oil shale treating chamber 2, by means of the above-mentioned gas containing the gaseous shale oil.

THe oil shale 23 continuously supplied into the oil shale treating chamber 2 through the oil shale supply port 4 at the top thereof continuously moves from the oil shale preheating chamber "a" and "b" to the oil shale distilling chamber "c". The high-temperature heating gas blown through the gas blowing port 10 into the oil shale distilling chamber "c" is introduced from the oil shale distilling chamber "c" through the gap 9B of the horizontal partition 8B into the oil shale preheating chamber "b" as shown by the arrow, then further introduced from the oil shale preheating chamber "b" through the gap 9A of the horizontal partition 8A into the oil shale preheating chamber "a" as shown by the arrow, and discharged from the gas discharge port 11 of the oil shale preheating chamber "a". In the meantime, the high-temperature heating gas passes, via the plurality of vent apertures 6 of the two vertical partitions 2*a* and 2*b*, through the oil shale 23 in the oil shale treating chamber 2, whereby the oil shale 23 is preheated in the oil shale preheating chambers "a" and "b", and the gaseous shale oil is distilled from the thus preheated oil shale 23 in the oil shale distilling chamber "c".

In FIG. 1, 12 is a first separator for separating by liquefaction a heavy oil from the gaseous shale oil contained in said high-temperature gas blown into the first separator 12 through inlet port 13*d* from the heating gas discharge port 11 of the vertical type distilling furnace 1. The first separator 12 which is, for example, a cyclone is provided at the bottom thereof with a shale oil discharge port 12*a* for discharging the thus separated heavy oil, and is further provided at the top thereof with a gas discharge port 12*b* for discharging the gas after separation of the heavy oil. The reference numeral 14 indicates a storage tank for storing the heavy oil 24 discharged from the shale oil discharge port 12*a* of the first separator 12, and 16 is a pump for discharging the heavy oil 24 from the storage tank 14.

Also in FIG. 1, 13 is a second separator for separated by liquefaction a light oil from the gaseous shale oil after separation of the heavy oil contained in said gas, introduced into the second separator 13 through the gas discharge port 12*b* of the first separator 12. The second separator 13 which is, for example, a cooler/condenser is provided at the bottom thereof with a light oil discharge port 13*a* for discharging the thus separated light oil, and at the top thereof with a waste gas discharge port 13*b* for discharging the gas after separation of the light oil. The reference numeral 13*c* indicates a pipe for circulating a cooling medium; 15 is a storage tank for storing the light oil 25 discharged from the light oil discharge port 13*a* of the second separator 13; and, 17 is a pump for transporting the light oil 25 contained in the storage tank 15. The second separator 13 is provided at the top in its inside with a nozzle 26 for ejecting part of the light oil 25 transported from the storage tank 15 by means of the pump 17 to cool the gas after separation of the heavy oil and introduced into the second separator 13.

In FIG. 1, 18 is a heat exchanger for heating to a high temperature a gas which is to be blown into the oil shale distilling chamber "c" of the vertical type distilling furnace 1; 19 is a screw conveyor for transferring a waste oil shale 23' discharged from the waste oil shale discharge port 5 of the oil shale treating chamber 2; and, 20 is a horizontally rotating type combustor for burning carbonaceous substances contained in the waste oil shale 23' transferred by the screw conveyor 19 to generate a high-temperature combustion waste gas. The waste oil shale 23' supplied into the combustor 20 through an end thereof is discharged through the rotating combustor 20 from the other end thereof, and in the meantime, fuel ejected from a burner 27 installed at the lower end of the combustor 20 toward the interior thereof and hot air generated in the blast generator 21 described later causes combustion of carbonaceous substances contained in the waste oil shale 23' to generate a high-temperature combustion waste gas.

The reference numeral 21 indicates a horizontally rotating type hot blast generator for heating air through heat exchange with the high-temperature waste oil shale 23' discharged from the combustor 20 and blowing the thus heated air into the combustor 20. The air blown into the hot blast generator 21 through an end thereof is heated in the hot blast generator 21 through heat exchange with the waste oil shale 23', which was heated to a high temperature by combustion of the carbonaceous substances in the combustor 20 and which was then supplied into the hot blast generator 21 from the other end thereof, and is blown into the combustor 20. The reference numeral 22 indicates a cooling tank for water-cooling the waste oil shale 23' after heat exchange with the air, discharged from the hot blast generator 21.

The gas after separation of the light oil discharged from the waste gas discharge port 13*b* of the second separator 13 and the high-temperature combustion waste gas generated in the combustor 20 are introduced into a heat exchanger 18, where the gas after separation of the light oil is heated through heat exchange with the high-temperature combustion waste gas and blown into the oil shale distilling chamber "c" of the vertical type distilling furnace 1. The reference numeral 28 indicates a valve installed in the middle of a pipe which directs the high-temperature combustion waste gas generated in the combustor 20 into the heat exchanger 18. Part of the high-temperature combustion waste gas generated in the combustor 20 may be blown directly into the oil shale distilling chamber "c"; and, 29 is another valve installed in the middle of a pipe which directs the high-temperature combustion waste gas directly into the oil shale distilling chamber "c".

Now, an example of operation based on the apparatus of the present invention is described. A vertical type distilling furnace 1 was used, which had a pair of gas chambers 3 and an oil shale treating chamber 2 which has a rectangular cross-section consisting of a pair of longer sides of 1.0 m and a pair of shorter sides of 0.6 m and a vertical length of 5 m. Each of the gas chambers 3 was provided adjacent to each of the longer sides of the oil shale treating chamber 2. An oil shale 23 was treated in an amount of 13 tons per day by supplying the oil shale continuously into the oil shale treating chamber 2 through a supply port 4 thereof. A gas heated in a heat exchanger 18 to a temperature of 600° C. was supplied from a heating gas blowing port 10 into an oil shale distilling chamber "c" of the vertical type distilling furnace 1 at a rate of 730 $Nm^3/H$. The high-temperature gas blown into the oil shale distilling chamber "c" passed horizontally through the oil shale 23 in the oil shale treating chamber 2 and heated in the meantime the oil shale 23 to a temperature of from 400° to 500° C. to distill a gas containing a gaseous shale oil from the oil shale 23.

The gas containing the gaseous shale oil was introduced from the oil shale distilling chamber "c" through a gap 9B of a horizontal partition 8B into an oil shale preheating chamber "b", then introduced from the oil shale preheating chamber "b" through a gap 9A of a horizontal partition 8A into an oil shale preheating chamber "a", passed horizontally through the oil shale 23 in the oil shale treating chamber 2, and preheated in the meantime the oil shale 23 with the heat contained in said gas.

Since the high-temperature gas blown into the oil shale distilling chamber "c" passed horizontally through the oil shale 23 contained in the oil shale treating chamber 2, there was only a slight pressure drop of the gas and a gas containing a gaseous shale oil was efficiently distilled from the oil shale 23 contained in the oil shale treating chamber 2. Then, since this gas containing the gaseous shale oil passed horizontally through the oil shale 23 contained in the oil shale treating chamber 2 in the oil shale preheating chambers "a" and "b", there was only a slight pressure drop of the gas, and the gas, after efficiently preheating the oil shale 23 contained in the oil shale treating chamber 2, was discharged with a temperature of about 150° C. from a heating gas discharge port 11 of the oil shale preheating chamber "a".

The gas, containing the gaseous shale oil, discharged from the heating gas discharge port 11, was introduced into a first separator 12 where the gas was cooled and a heavy oil 24 having a high boiling point was separated from the gas, whereby the heavy oil 24 was recovered from the gas in the first separator 12. Then, the gas after separation of the heavy oil 24 was discharged from the first separator 12 through a gas discharge port **12*b*, and introduced into a second separator 13. The gas introduced into the second separator 13 where the gas was cooled and a light oil 25 having a low boiling point was separated from the gas, whereby the light oil 25 was recovered from the gas in the second separator 13**.

In the oil shale treating chamber 2, on the other hand, a waste oil shale 23' after distillation of the gaseous shale oil, brought to a temperature of about 500° C., was discharged from an oil shale discharge port 5 provided at the lower end of the oil shale treating chamber 2, transferred by a screw conveyor 19 to a combustor 20 and supplied into the combustor 20. Carbonaceous substances contained in the waste oil shale 23' supplied into the combustor 20 were burnt by a fuel ejected from a burner 27 and a hot blast generated in a blast generator 21. As a result, a combustion waste gas at a temperature of about 880° C. was generated in the combustor 20. This combustion waste gas was introduced into a heat exchanger 18 where the combustion waste gas heated the gas discharged from the waste gas discharge port **13*b* of the second separator 13 after separation of the light oil to a temperature of about 600° C. through heat exchange. Thus, the gas heated to a temperature of about 600° C. was blown into the oil shale distilling chamber "c" of the distilling furnace 1 through a heating gas blowing port 10** thereof.

The high-temperature waste oil shale 23' after combustion of the carbonaceous substances contained therein in the combustor 20 exchanged heat with the air supplied by blowing into the blast generator 21 through an end thereof to heat the air. The high-temperature air thus generated was blown into the combustor 20 and accelerated combustion of the carbonaceous substances contained in the waste oil shale 23' in the combustor 20. The waste oil shale 23' after heat exchange with the air in the blast generator 21 was supplied into a cooling tank 22 and rejected after cooled by water contained in the cooling tank 22.

An appropriate size of the oil shale treating chamber 2 in the vertical type distilling furnace 1 should be selected, depending upon the quantity of oil shale to be treated, and the properties of the oil shale to be treated such as fluidity, adherence and strength. For example, installation of 16 distilling furnaces each provided with an oil shale treating chamber having a rectangular cross-section consisting of a pair of shorter sides of 1 m and a pair of longer sides of 10 m and a vertical length of 10 m allows treatment of oil shale in a quantity of 20,000 ton per day.

In the example described above, the vertical type distilling furnace is divided by two horizontal partitions into a lower oil shale distilling chambers and two upper oil shale preheating chambers. However, depending upon the size of the vertical type distilling furnace, it may be divided by a horizontal partition into a lower oil shale distilling chamber and an upper oil shale preheating chamber, or by three or more horizontal partitions into a lower oil shale distilling chamber and three or more upper oil shale preheating chambers. Also in the example given above, two separators for separating by liquefaction the shale oil from the gas containing the gaseous shale oil discharged from the distilling furnace are provided, in which one is for separating the heavy oil and the other is for separating the light oil. The number of separators is not however limited to two, but may be one or three or more.

In the example given above, as the high-temperature gas which is blown into the oil shale distilling chamber of the vertical type distilling furnace, the gas after separation of the light oil in the second separator is heated through heat exchange in the heat exchanger with the high-temperature combustion waste gas generated by burning the carbonaceous substances contained in the waste oil shale and the resultant high-temperature gas is used in recycle. This high-temperature gas blown into the oil shale distilling chamber is not limited to the gas after separation of the light oil, but a combustion waste gas or other gas generated in a plant may be used as it is, or by heating through heat exchange with the above-mentioned high-temperature combustion waste gas in a heat exchanger.

According to the apparatus of the present invention, as described above in detail, when distilling a shale oil from an oil shale, there is only a slight pressure drop of the high-temperature gas blown into the distilling furnace, and therefore, it is possible to treat a large quantity of oil shale continuously at a high efficiency in a large-capacity distilling furnace and to obtain a high-quality shale oil, thus providing industrially useful effects.

What is claimed is:

1. An apparatus for distilling a shale oil from an oil shale, which comprises:

a vertical type distilling furnace which is vertically divided by two vertical partitions each having a plurality of vent apentures into an oil shale treating chamber and two gas chambers, said oil shale treating chamber being located between said two gas chambers, said oil shale treating chamber having an oil shale supply port at the top thereof and a waste oil shale discharge port at the bottom thereof, whereby oil shale supplied to said oil shale supply port moves into said oil shale treating chamber and continuously downwardly toward said waste oil shale discharge port, said oil shale treating chamber and said two gas chambers being divided by at least one horizontal partition into a lower oil shale distilling chamber and at least one upper oil shale preheating chamber, said oil shale distilling chamber and said oil shale preheating chamber communicating with each other through a gap provided at an end of said at least one horizontal partition, said oil shale distilling chamber having a heating gas blowing part, means for blowing high-temperature heating gas into said oil shale distilling chamber through said heating gas blowing port to distill gaseous shale oil from oil shale in said oil shale distilling chamber, said at least one oil shale preheating chamber having at the upper portion thereof a heating gas discharge port for discharging said heating gas from said oil shale distilling chamber, said oil shale preheating chamber containing means to preheat oil shale therein by use of said heating gas from said oil shale distilling chamber;

at least one separator (12, 13) for liquefying by cooling the gaseous shale oil contained in said heating gas into a liquid shale oil to separate said gaseous shale oil from said heating gas:

said at least one separator having an inlet port (13*g*) for introducing said heating gas containing said gaseous shale oil into said at least one separator, a shale oil discharge port (12*a*, 13*a*) for discharging said liquid shale oil, and a waste gas discharge port (13*b*) for discharging said heating gas after separation of said gaseous shale oil;

means for communicating said inlet port (13*d*) of said at least one separator (12, 13) for introducing said heating gas containing said gaseous shale oil with said heating gas discharge port (11) of said at least one oil shale preheating chamber ("a", "b"); and, means for communicating said waste gas discharge port (13*b*) of said at least one separator (12, 13) with said heating gas blowing port (10) of said oil shale distilling chamber ("c");

whereby said high-temperature heating gas which is blown into said oil shale distilling chamber ("c") through said heating gas blowing port (10) heats oil shale in said oil shale distilling chamber ("c") to distill gaseous shale oil from said oil shale, then, said heating gas containing said gaseous shale oil is introduced through said gap (9A, 9B) of said at least one horizontal partition (8A, 8B) into said at least one oil shale preheating chamber ("a", "b") to preheat the oil shale therein, then, said heating gas containing said gaseous shale oil is passed through said heating gas discharge port (11) of said at least one oil shale preheating chamber ("a", "b") into said at least one separator (12, 13), where said gaseous shale oil contained in said heating gas is liquefied by cooling into a liquid shale oil to separate said gaseous shale oil from said heating gas, and then, said heating gas after separation of said gaseous shale oil is recirculated through said waste gas discharge port (13*b*) of said at least one separator (12, 13) and said heating gas blowing port (10) of said oil shale distilling chamber ("c") into said vertical type distilling furnace (1).

2. The apparatus of claim 1, including a combustor (20) for burning carbonaceous material contained in waste oil shale after distillation of said gaseous shale oil discharged from said waste oil shale discharge port (5) of said oil shale treating chamber (2) to produce a high-temperature combustion exhaust gas; and a heat exchanger (18) for heating to a high temperature said heating gas after separation of said gaseous shale oil which is discharged from said waste gas discharge port (13*b*) of said at least one separator (12, 13) and which is recirculated to said vertical type distilling furnace (1), through heat exchange with said high-temperature combustion exhaust gas supplied from said combustor (20).

* * * * *